US009010388B2

(12) United States Patent
Sanchez

(10) Patent No.: US 9,010,388 B2
(45) Date of Patent: Apr. 21, 2015

(54) ICE-CHANNELING TRAY FOR USE WITH A MULTIPLE RECEPTACLE CARRIER

(76) Inventor: David Sanchez, Corpus Christi, TX (US)

( * ) Notice: Subject to any disclaimer, the term of this patent is extended or adjusted under 35 U.S.C. 154(b) by 415 days.

(21) Appl. No.: 13/234,729

(22) Filed: Sep. 16, 2011

(65) Prior Publication Data

US 2013/0068348 A1 Mar. 21, 2013

(51) Int. Cl.
*B65B 39/00* (2006.01)
*B65B 67/02* (2006.01)

(52) U.S. Cl.
CPC ..... *B65B 39/007* (2013.01); *B65B 67/02* (2013.01); *B67D 2210/00068* (2013.01); *B65B 2039/009* (2013.01)

(58) Field of Classification Search
CPC ..... B65B 39/00; B65B 39/007; B65B 39/06; B65B 67/02; B67C 11/00; B67C 11/02; B67D 2210/00068
USPC ..... 141/237, 247, 297, 331, 340, 363–366
See application file for complete search history.

(56) References Cited

U.S. PATENT DOCUMENTS 212,494 A * 2/1879 Paddock ..... 141/238
2,447,281 A 8/1948 Schneir
2,685,395 A 8/1954 Levine
3,566,929 A * 3/1971 Mead ..... 141/237
3,693,673 A 9/1972 Oates
3,794,088 A 2/1974 Harvey
4,524,866 A * 6/1985 Pollacco ..... 206/223
4,800,934 A * 1/1989 Boissoneault ..... 141/106
4,880,156 A * 11/1989 Wallet ..... 232/43.1
4,972,886 A 11/1990 Bernstein
5,139,059 A 8/1992 Dierkes
5,458,169 A * 10/1995 Biafore ..... 141/333
5,503,246 A * 4/1996 Raboin et al. ..... 184/1.5
6,109,313 A * 8/2000 Phelps ..... 141/106
6,644,366 B2 * 11/2003 Johnson ..... 141/331
7,308,919 B1 * 12/2007 Zavala ..... 141/247
2002/0185194 A1 12/2002 Guzman

* cited by examiner

*Primary Examiner* — Timothy L Maust
*Assistant Examiner* — Timothy P Kelly

(57) ABSTRACT

A material-channeling tray comprising a tray surface, an opposing bottom surface, and a sidewall extending from the tray surface and bottom surface. The tray surface has a plurality of channel openings and a handle opening extending through the tray surface and the bottom surface. The sidewall has an exterior surface and an interior surface, with the interior surface and tray surface defining a tray volume. The sidewall extends away from the tray surface forming an angle between the interior surface and the tray surface that is at least ninety degrees. The invention further comprises a plurality of channel walls, each forming a channel, wherein the plurality of channel walls are attached to and extend from the bottom surface, and each of the channels is positioned subjacent to one of the channel openings.

20 Claims, 12 Drawing Sheets

ICE-CHANNELING TRAY FOR USE WITH A MULTIPLE RECEPTACLE CARRIER

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to food service equipment. More specifically, the present invention relates to equipment used to distribute ice into drink receptacles.

2. Description of the Related Art

Athletic trainers are healthcare providers tasked with the prevention, diagnosis and intervention of emergency, acute and chronic medical conditions associated with the participation in sports. In organized sports, for example, the athletic trainer is primarily responsible for implementing proper injury prevention measures to ensure each of the participants is properly prepared to engage in the activity. The trainer may also be responsible for ensuring proper hydration prior to and throughout the activity to avoid cramping or more serious injury, such as dehydration or heat stroke.

Unfortunately, a significant amount of time during organized sports requires the trainer to perform tasks other than focusing on the welfare of the participants and the prevention of injury, especially in athletic programs with limited budgets, where the athletic trainer may also be the equipment manager, facilities manager, groundskeeper, and general jack-of-all-trades. For example, instead of focusing attention on the participants, the trainer may be filling water bottles for an entire football team to make sure the players are properly hydrated.

In fact, due to the sheer number of participants in organized sports, ensuring proper hydration becomes a very time-consuming activity. A typical football team, for example, may have over one-hundred players and another twenty staff. During pre-season training in the heat of the day, or during the course of a three hour football game, each of those players needs to have hydration readily available.

"Readily available" hydration, however, can require during a particular activity filling hundreds of drink receptacles with ice and liquid (such as water or a sports drink) and transporting the filled drink receptacles to different positions around the field or facilities. Typically, the drink receptacles are generally-cylindrical plastic bottles that may be carried in a multiple-receptacle holder with an upwardly extending handle. Because of the shape and relatively small opening of the receptacles, filling them with ice is particularly time-consuming and inefficient. If the athletic trainer is also filing the receptacles with ice, this is not optimal use of the trainer's time, which should instead be focused on the athletic participants in order to observe any potential warning signs of ailment or injury, such as heat stroke or cramping.

BRIEF SUMMARY OF THE INVENTION

The present invention provides an apparatus to lessen the amount of time spent preparing hydration for a large organized sports team when using ice. The invention provides an ice-channeling tray comprising a tray surface, an opposing bottom surface, and a sidewall extending from the tray surface and bottom surface. The tray surface has a plurality of channel openings and a handle opening extending through the tray surface and the bottom surface. The sidewalls have an exterior surface, and an interior surface with the interior surface and tray surface defining a tray volume. The sidewall extends away from the tray surface forming an angle between the interior surface and the tray surface which is at least ninety degrees. The invention further comprises a plurality of channel walls, each forming a channel, wherein the plurality of channel walls are attached to and extend from the bottom surface, and each of the channels is positioned subjacent to one of the channel openings.

As the ice is distributed into the tray volume, the sloped surfaces of the elongate member and the sloped section between the channel openings, in combination with the inner surface of the sidewall, cause the ice to move toward the channel openings. This aids in preventing ice from accumulating in the tray volume and facilitates quick distribution of ice into the drink receptacles, either when the ice is moved around the tray or as a result of the motion of the carrying person during transport of the receptacles and apparatus to a different position of the field.

While there are other trays for channeling fluids, the present invention is distinguishable from them for at least three reasons. First, other trays do include structure for positioning on a multiple receptacle carrier so that channels of the tray are in alignment with the contained receptacles. For example, U.S. Pat. No. 4,972,886 teaches an ice distribution tray that functions in conjunction with a plurality of drink receptacles, but the structure of the '886 invention is insufficient for placement and support on a sport drink carrier. In addition, the height of the sidewalls is insufficient to contain ice within the tray volume during transport. Finally, other trays do not include a tray surface that comprises sloped sections between the openings to facilitate the movement of ice into the openings and through the channels.

By using the invention, ice may be distributed into the tray volume and evenly distributed therein. As the ice is distributed, either manually or by shaking the tray, the shaping of the tray causes the ice be directed through the openings and channels into the receptacles when the receptacles are already positioned in the holder. Moreover, the invention may be carried in conjunction with the carrier, resulting in ice moving into the openings and channels as a result of the normal up-and-down motion of the carrier as the transporter is walking or running between positions on the field. Thus, filling the receptacles with ice may be accomplished by transporting the carrier, receptacles and tray to a different position on the field.

In addition to the foregoing advantages, the present invention will reduce potential sanitation and safety issues often encountered when filling receptacles with ice. For example, student trainers will no longer have to insert the vessels into the ice supply that is contained by an ice machine or ice chest. After use, the receptacles have to be refilled, and inserting the receptacles into the ice supply potentially contaminates most or all of the supply. Considering the large number of bottles in use by, for example, a football team having one hundred or more players, this increases the chance of contamination of the entire ice supply. Moreover, athletic trainers will have an option of filling the receptacles with ice in an indoor activity without spilling ice all over the floor or playing surface while minimizing a potential safety problem of ice spilling to the floor and creating a slippery surface.

DETAILED DESCRIPTION OF THE INVENTION

Figure 1:
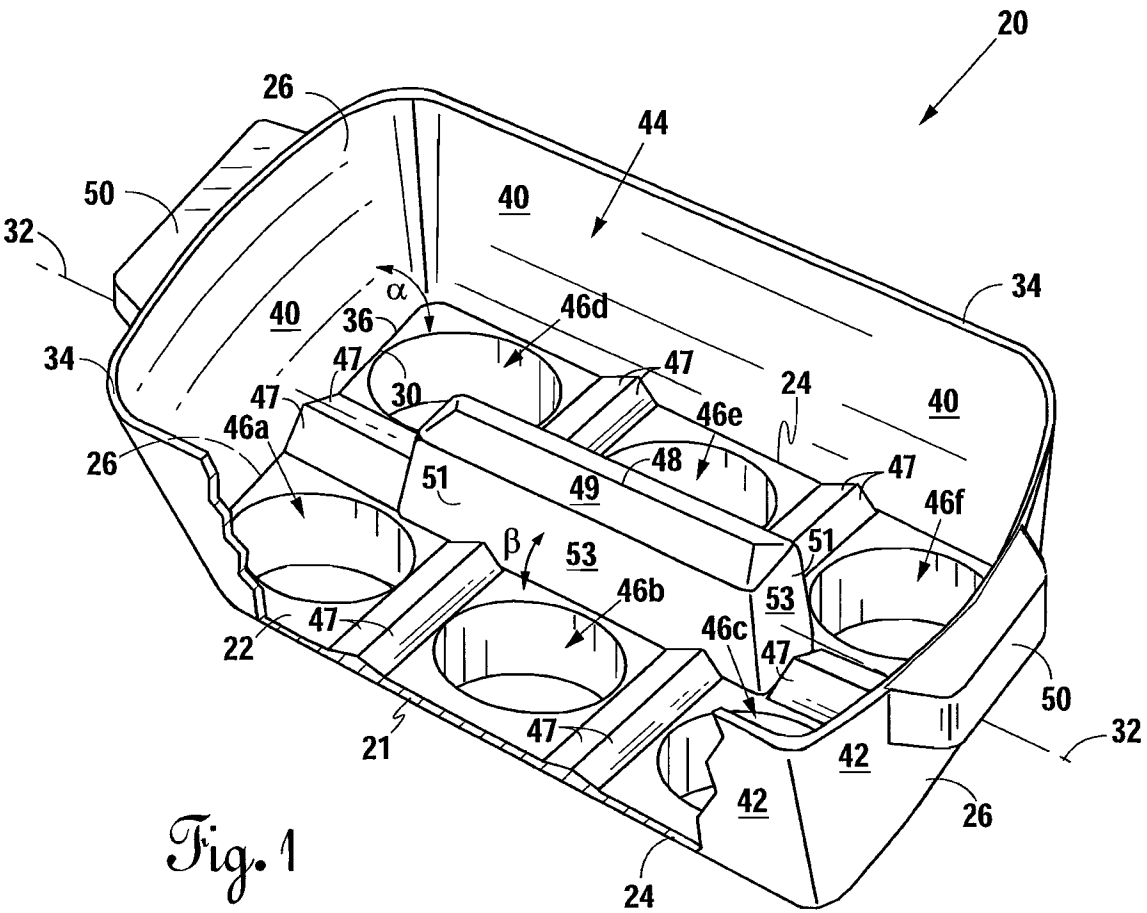
FIG. 1 is a top isometric view of the preferred embodiment of the present invention.
Figure 2:
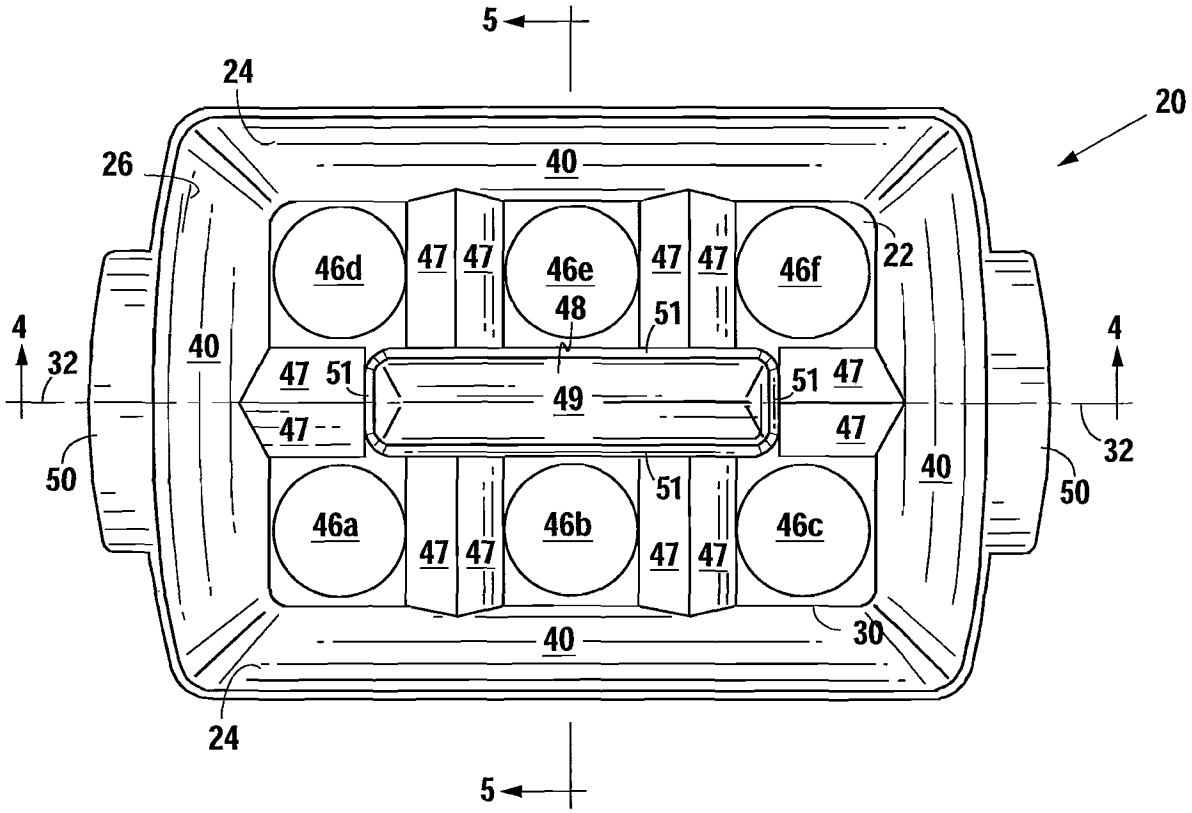
FIG. 2 is a top elevation of the preferred embodiment.

As shown in FIGS. 1-2, the tray 20 of the preferred embodiment of the present invention is described in an orientation in which it would normally be used. The tray 20 can be a molded plastic body, and comprises a rectangular tray bottom 21 with a tray surface 22 having opposing long sides 24, and opposing wide sides 26. A longitudinal primary axis of orientation 32 parallels and is equidistant from each of the long sides 24 and bisects the wide sides 26 of the tray surface 22.

A surrounding sidewall 34 having an interior surface 40 and an exterior surface 42 extends from the long sides 24 and wide sides 26 of the tray surface 22. The interior surface 40 of the sidewall 34 and the tray surface 22 define an open tray volume 44. The sidewall 34 extends upwardly from the tray surface 22 such that the angle $\alpha$ formed between the interior surface 40 of the sidewall 34 and the tray surface 22 is ninety degrees or greater. The preferred angle $\alpha$ is one-hundred ten degrees, plus or minus five degrees, although the angle $\alpha$ need not be uniform around the entire tray surface 22. Opposing carrying handles 50 can extend laterally from the outer surface 42 of the sidewall 34 at the wide sides 26.

Figure 3:
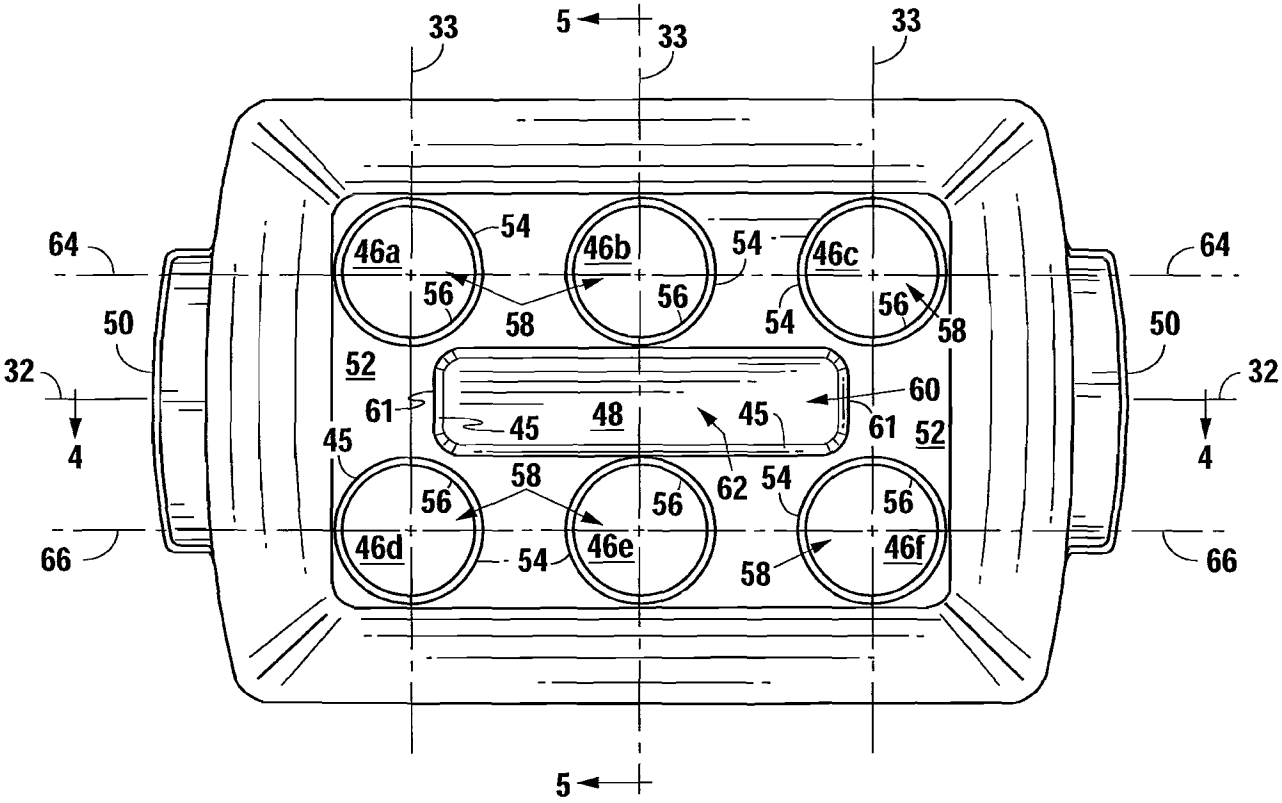
FIG. 3 is a bottom elevation of the preferred embodiment.

As shown in FIG. 3, an elongated rectangular handle opening 60 is centered in the tray surface 22 along the primary axis of orientation with each short side 61 of the rectangular handle opening 60 being equidistant from the wide sides 26 of the tray surface 22. The handle opening 60 is positioned to receive a handle 70 of a multiple receptacle carrier 68 therethrough (see FIGS. 4-6).

In the preferred embodiment of the present invention, a handle cover 48 is positioned to cover the handle opening 60 from above and extends away from the tray surface 22 into the tray volume 44. The handle cover 48 has a top surface 49 and a sidewall 51 that is angled relative to the tray surface 22.

The top surface 49 and the interior surfaces 45 of the sidewall 51 define a volume 62 for receiving a handle of a receptacle carrier therein. Preferably, the sidewall 51 of the handle cover 48 extends from the tray surface 22 at the edges of the handle opening 60 and slopes inwardly towards the top surface 49 at an angle $\beta$ that is equal to or greater than ninety degrees.

A plurality of channel openings **46*a*-46*f* are formed through the tray bottom 21 and are arranged in a rectangular pattern on the tray surface 22. In the preferred embodiment, each of the channel openings 46*a*-46*f*** are circular, however, it is anticipated that other shapes may be used.

Each of the channel openings **46*a*-46*f* are sized and positioned on the tray surface 22 such that at least a portion of their edges are adjacent the interior surface 40 of the sidewall 34 of the tray 20 and the exterior surface 53 of the sidewall 51 of the handle cover 48. In this position, the interior surface 40 of the sidewall 34 and the sidewall 51 of the handle cover 48 tend to urge ice or other material in the tray 20 towards the channel openings 46*a*-46*f***.

In the preferred embodiment, intermediate sloped surfaces 47 are positioned adjacent to and between the channel openings **46*a*-46*f* and angled relative to the tray surface 22. It is anticipated that these additional sloped surfaces could be positioned or arranged in a variety of positions. In the preferred embodiment, these intermediate sloped surfaces 47 are positioned between the adjacent channel openings where a flat tray surface would otherwise be located. The intermediate sloped surfaces 47 are positioned and arranged such that two of the sloped surfaces 47 are adjoining and slope downward and away from each other toward adjacent channel openings and extend from the interior surface 40 of the sidewall 34 to the exterior surface 53 of the sidewall 51 of the handle cover 48**.

In operation, the intermediate sloped surfaces 47 tend to urge ice or other material in the tray toward the channel openings **46*a*-46*f*. The sloped surfaces 47 positioning and arrangements also decreases the amount of flat surface area of the tray surface 22 where material in the tray 20 can settle, thereby making the channeling operation of the tray 20** more efficient.

The channel openings **46*a*-46*f* comprise a first group of three openings 46*a*-46*c* having centers aligned along a first longitudinal axis 64 that is parallel to the primary axis of orientation 32, and a second group of three openings 46*d*-46*f* having centers aligned along a second longitudinal axis 66 that is also parallel to the primary axis of orientation 32. The first longitudinal axis 64 and the second longitudinal axis 66 are equidistant from and on opposite sides of the primary longitudinal axis 32. The handle opening 60 is positioned between the first and second groups of openings 46*a*-46*f***.

Figure 4:
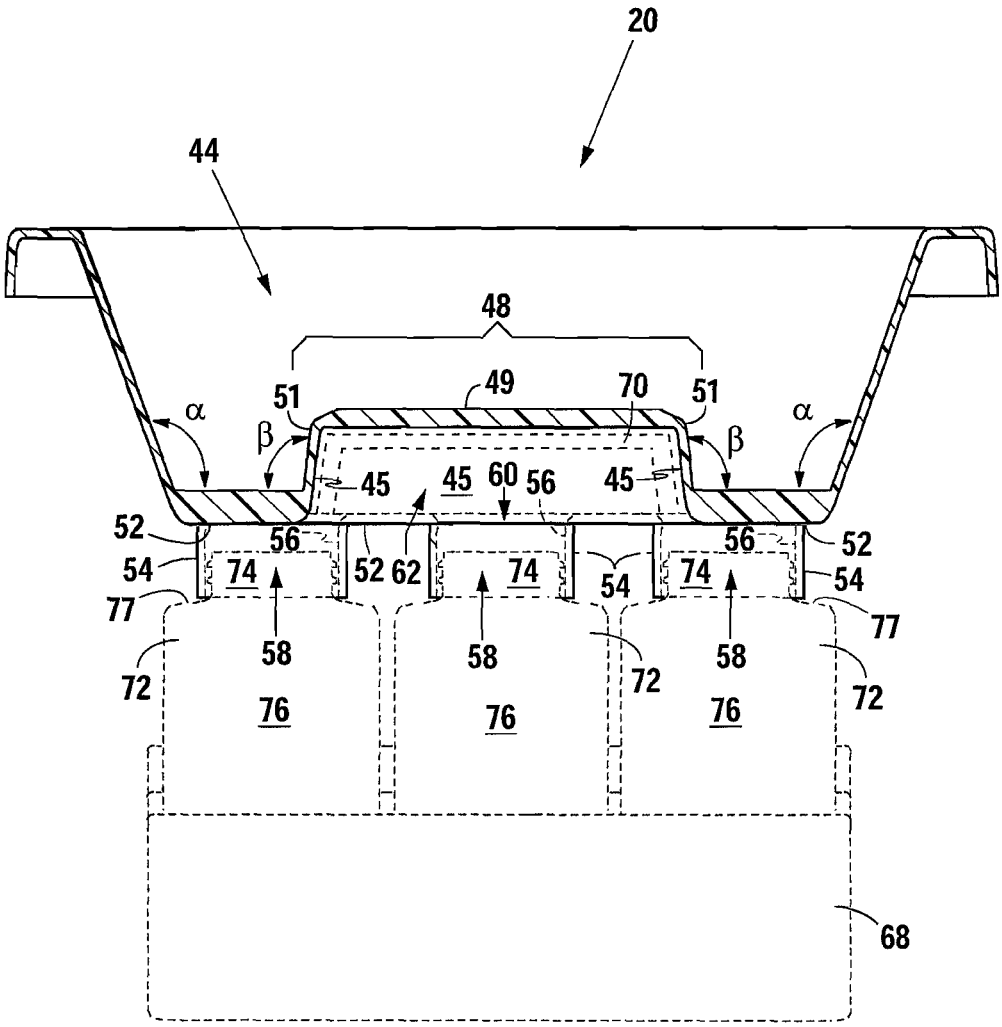
FIG. 4 is a sectional elevation through line 4-4 of FIGS. 2 & 3

As shown in FIG. 3-4, the tray 20 has a bottom surface 52 opposing the tray surface 22, with the channel openings **46*a*-46*f* extending through and accessible from the bottom surface 52. A plurality of channel walls 54, each having an interior surface 56, extend from the bottom surface 52 to form cylindrical channels 58, with one channel 58 being positioned subjacent to each one of the channel openings 46*a*-46*f*. However, it is anticipated that the shape of the channels 58** could vary depending upon the shape of the receptacles.

Figure 5:
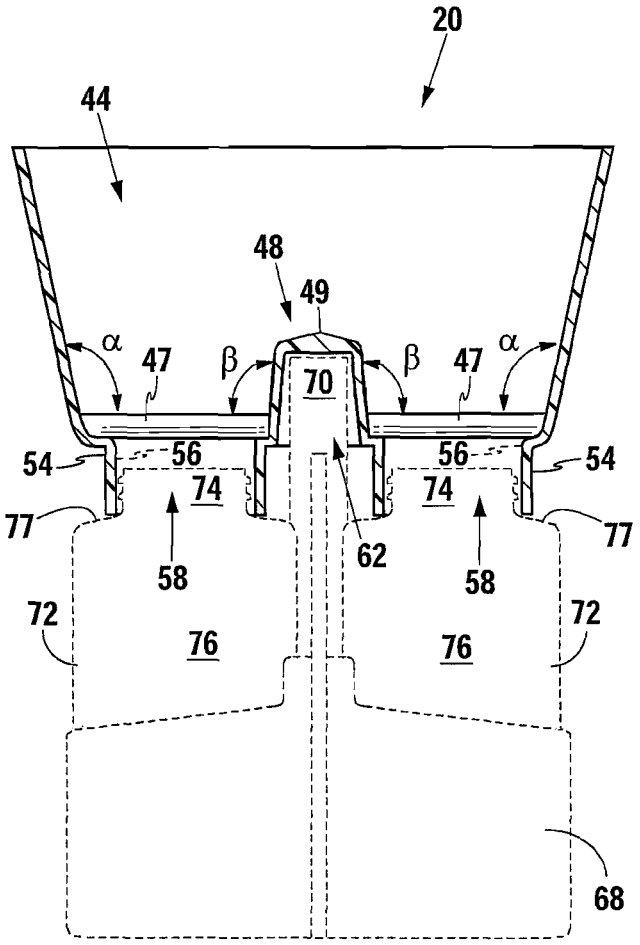
FIG. 5 is a sectional elevation through line 5-5 of FIGS. 2 & 3.

FIGS. 4-5 show how the tray 20 of the preferred embodiment may be used with a multiple receptacle carrier 68 with a carrier handle 70. The carrier 68 holds six identical drink receptacles 72, such as sports beverage containers, in two rows of three receptacles 72 each. Each receptacle 72 has a cylindrical top portion 74 for receiving a lid and a cylindrical body portion 76 subjacent to its top portion 74, with the body portion 76 having an outer diameter greater than the outer diameter of the top portion 74 forming a shoulder 77 therebetween. However, it is anticipated that other embodiments of the tray 20 could be used with various receptacle carriers 68 and shapes of drink receptacles 72.

In the preferred embodiment, the inner diameter of each channel 58 is larger than outer diameter of the top portions 74 of the drink receptacles 72. The handle opening 60 has a width greater than the width of the carrier handle 70, and a length greater than the length of the carrier handle 70. When the tray 20 is properly positioned on the receptacle carrier 68, the bottom end of the channel walls 54 contact the shoulder 77 and the carrier handle 70 inserts through the handle opening 60.

Still referring to FIGS. 4-5, the handle cover 48 is positioned to and covers the carrier handle 70 when the tray 20 is properly positioned on the carrier. Preferably, the elongate portions of the sidewall 51 of the handle cover 48 are flexible so that they may be urged inward against the carrier handle 70 when the handle cover 48 is grabbed. In this manner, the carrier handle 70 may be grasped with the handle cover 48 and lifted along with the tray 20. In an alternative embodiment of the present invention, the handle cover 48 may not be present, leaving the handle opening 60 exposed. In this alternative embodiment, the carrier handle 70 may be directly grasped and lifted along with the tray 20.

In the preferred embodiment, the size of the tray volume 44 is equal to or greater than the combined volume of the receptacles 72. For example, if each receptacle 72 has a volume $V_R$, then the aggregate volume of the receptacles 72 held by the six-receptacle carrier 68 is $6V_R$. Thus, in the preferred embodiment, the tray volume 44 is equal to at least $6V_R$.

Figure 6:
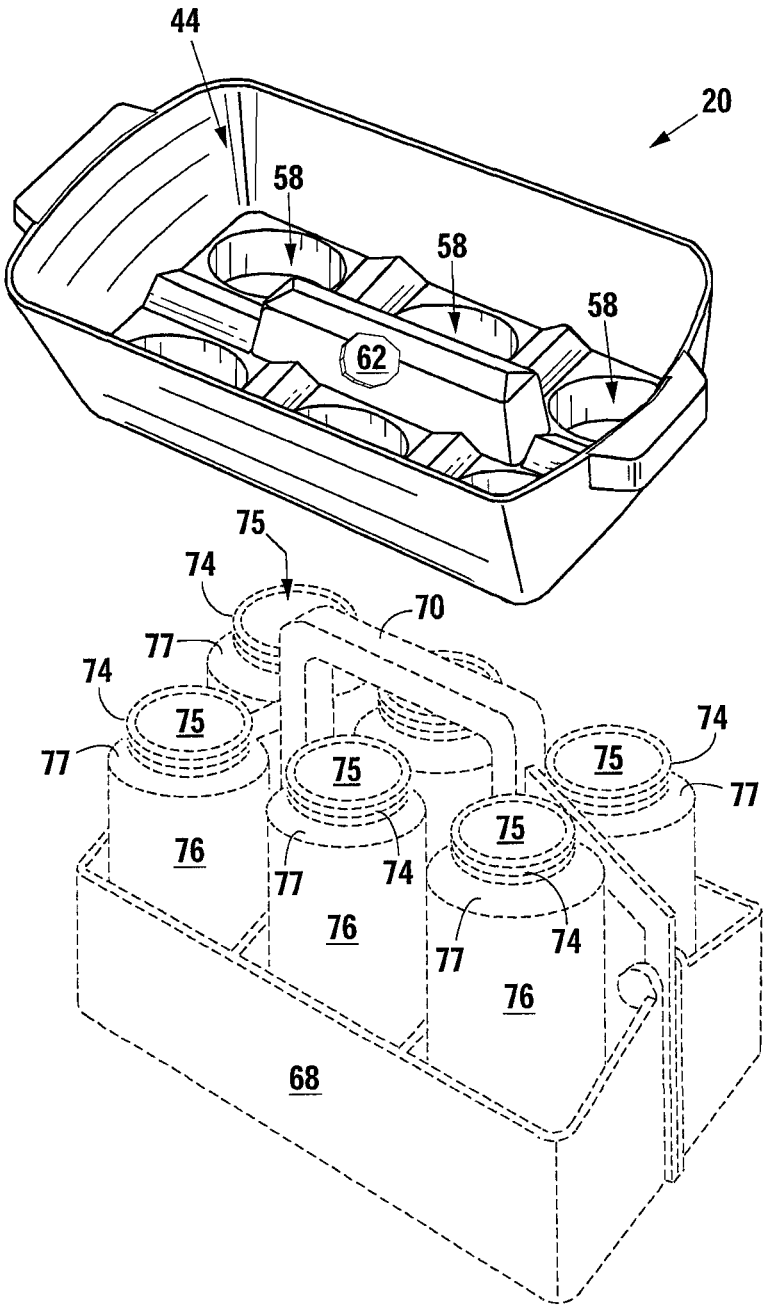
FIGS. 6 & 7 show use of the embodiment described with reference to FIGS. 1-5.

Use of the tray 20 is described with reference to FIGS. 6-7. As shown in FIG. 6, each of the channels 58 is initially aligned with and positioned over the top portion 74 of a receptacle 72 contained within the carrier 68, and the handle opening 60 aligned with and positioned over the carrier handle 70. The tray 20 is thereafter lowered to the carrier 68 (or the carrier 68 lifted to the tray 20) so that the carrier handle 70 is received through the handle opening 60 and within the handle cover 48 and the bottom ends of the channel walls 54 rest on the shoulders 77 of the receptacles 72 and the receptacle openings 75 are positioned within the channels 58. In alternative embodiments, the channel walls 54 may be positioned through the receptacle openings 75 and the bottom surface 52 resting against and supported by the top portions 74 of the receptacles 72.

Figure 7:
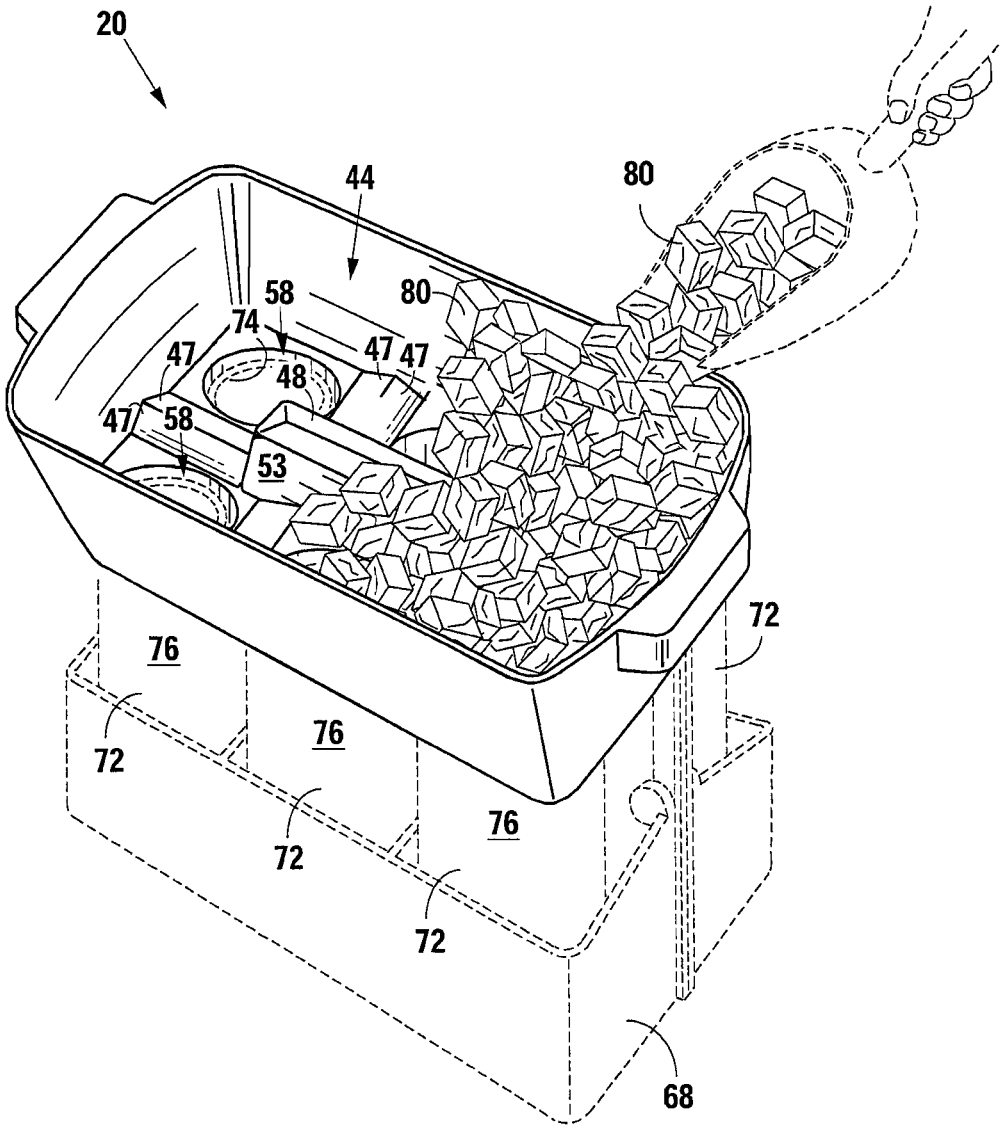

As shown in FIG. 7, ice 80 may thereafter be deposited into the tray volume 44 and evenly distributed therein. As the ice 80 is deposited, it falls through the openings **46*a*-46*f* and channels 54 into the receptacles 72. Even when ice 80 occupies the tray volume 44, the tray 20 may be carried in conjunction with the carrier 68 by forcing the opposing sidewalls 51 inward and grasping the carrier handle 70 through the handle cover 48. Because the size of the tray volume 44 is at least equal to the combined volume of all of the receptacles 72, by completely filling the tray volume 44 with ice, the user of the tray 20 can ensure all of the receptacles 72 will be filled with the initial distribution of ice 80**.

As the ice 80 is distributed into the tray volume 44, the sidewall 51 of the handle cover 48, the intermediate sloped surfaces 47 between the channel openings **46*a*-46*f* and the interior surface 40 of the sidewall 34 urge the ice 80 toward the channel openings 46*a*-46*f*. This aids in preventing ice 80 from accumulating in the tray volume 44 and facilitates quick distribution of ice 80 into the drink receptacles 76**.

Figure 8:
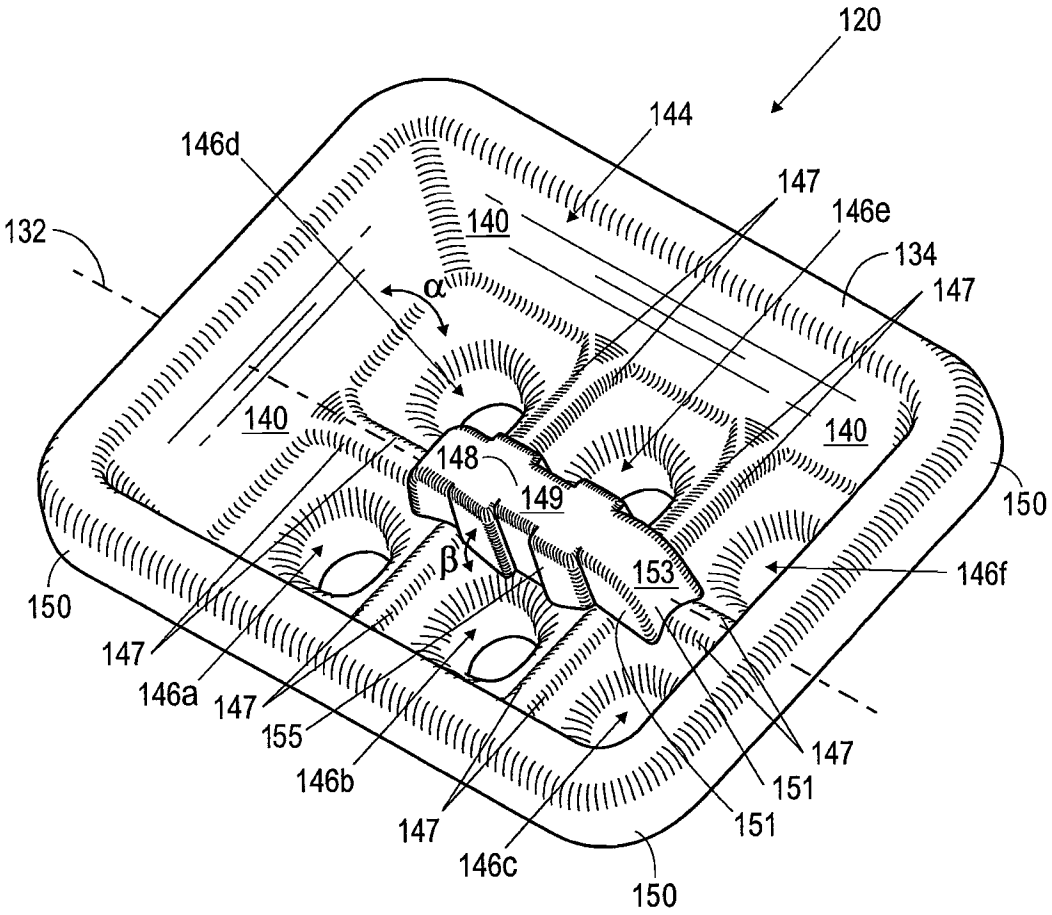
FIG. 8 is a top isometric view of an alternative embodiment of the present invention.
Figure 9:
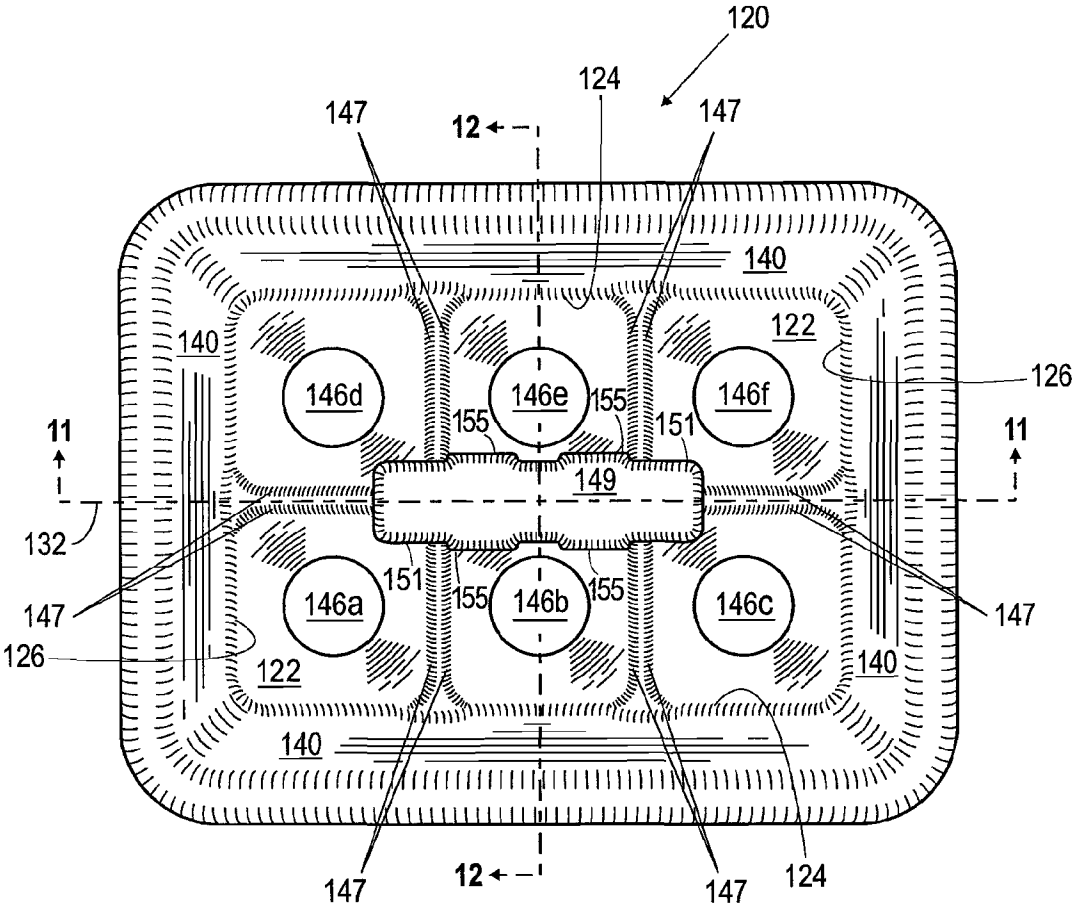
FIG. 9 is a top elevation of the alternative embodiment.
Figure 10:
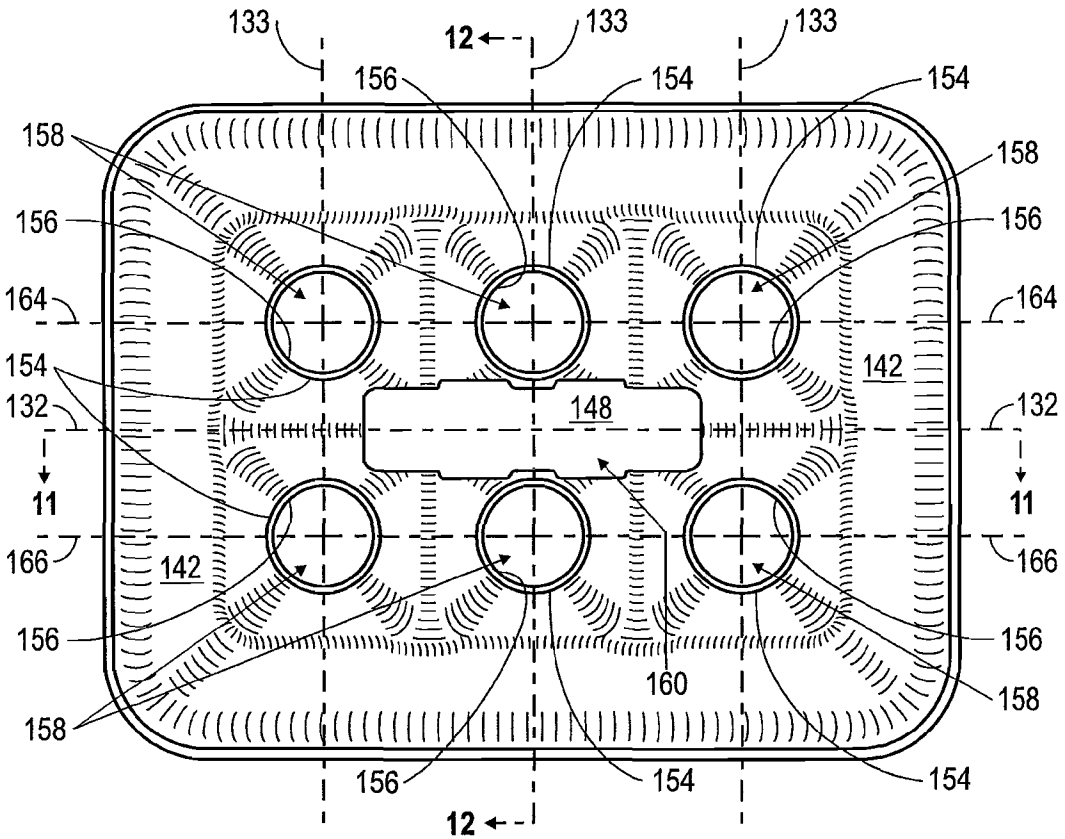
FIG. 10 is a bottom elevation of the alternative embodiment.

FIGS. 8-12 show an alternative embodiment of a tray 120 having the features of the present invention. As shown in FIGS. 8-10, the tray 120 can be a molded plastic body, and comprises a rectangular tray bottom 121 with a tray surface 122 having opposing long sides 124, and opposing wide sides 126. A longitudinal primary axis of orientation 132 parallels and is equidistant from each of the long sides 124 and bisects the wide sides 126 of the tray surface 122.

A surrounding sidewall 134 having an interior surface 140 and an exterior surface 142 extends from the long sides 124 and wide sides 126 of the tray surface 122. The interior surface 140 of the sidewall 134 and the tray surface 122 define an open tray volume 144. The sidewall 134 extends upwardly from the tray surface 122 such that the angle $\alpha$ formed between the interior surface 140 of the sidewall 134 and the tray surface 122 is ninety degrees or greater. The preferred angle $\alpha$ is one-hundred ten degrees, plus or minus five degrees, although the angle $\alpha$ need not be uniform around the entire tray surface 122. A top portion of the sidewall is curved to form a continuous carrying handle 150 that extends around the perimeter of the sidewall can extend laterally from the outer surface 142 of the sidewall 34 at the wide sides 26.

As shown in FIG. 10, an elongated rectangular handle opening 160 is centered in the tray surface 122 along the primary axis of orientation 132 with each short side 161 of the rectangular handle opening 160 being equidistant from the wide sides 126 of the tray surface 122. The handle opening 160 is positioned to receive a handle 170 of a multiple receptacle carrier 168 therethrough (see FIGS. 11-13).

A handle cover 148 is positioned to cover the handle opening 160 from above and extends away from the tray surface 122 into the tray volume 144. The handle cover 148 has a top surface 149 and a sidewall 151 that is angled relative to the tray surface 122. The sidewall cover has protrusions 155 extending outwardly from the long sides of the handle cover 148.

The top surface 149 and the interior surfaces 145 of the sidewall 151 define a volume 162 for receiving a handle of a receptacle carrier therein. Preferably, the sidewall 151 of the handle cover 148 extends from the tray surface 122 at the edges of the handle opening 160 and slopes inwardly towards the top surface 149 at an angle $\beta$ that is equal to or greater than ninety degrees.

A plurality of channel openings **146*a*-146*f* are formed through the tray bottom 121 and are arranged in a rectangular pattern on the tray surface 122. In the preferred embodiment, each of the channel openings 146*a*-146*f*** are circular, however, it is anticipated that other shapes may be used.

Each of the channel openings **146*a*-146*f* are sized and positioned on the tray surface 122 such that at least a portion of their edges are adjacent the interior surface 140 of the sidewall 134 of the tray 120 and the exterior surface 153 of the sidewall 151 of the handle cover 148. In this position, the interior surface 140 of the sidewall 134 and the sidewall 151 of the handle cover 148 tend to urge ice or other material in the tray 20 towards the channel openings 146*a*-146*f***.

Curved intermediate sloped surfaces 147 are positioned adjacent to and between the channel openings **146*a*-146*f* and angled relative to the tray surface 122. These intermediate sloped surfaces 147 are positioned between the adjacent channel openings where a flat tray surface would otherwise be located. The intermediate sloped surfaces 147 are positioned and arranged such that they slope downward toward adjacent channel openings and extend from the interior surface 140 of the sidewall 134 to the exterior surface 153 of the sidewall 151 of the handle cover 148**.

In operation, the intermediate sloped surfaces 147 tend to urge ice or other material in the tray toward the channel openings **146*a*-146*f*. The sloped surfaces 147 positioning and arrangements also decreases the amount of flat surface area of the tray surface 122 where material in the tray 120 can settle, thereby making the channeling operation of the tray 120** more efficient.

The channel openings **146*a*-146*f* comprise a first group of three openings 146*a*-146*c* having centers aligned along a first longitudinal axis 164 that is parallel to the primary axis of orientation 132, and a second group of three openings 146*d*-146*f*** having centers aligned along a second longitudinal axis 166 that is also parallel to the primary axis of orientation 132. The first longitudinal axis 64 and the second longitudinal axis 66 are equidistant from and on opposite sides of the primary longitudinal axis 132. The handle opening 60 is positioned between the first and second groups of openings 146*a*-146*f*.

Figure 11:
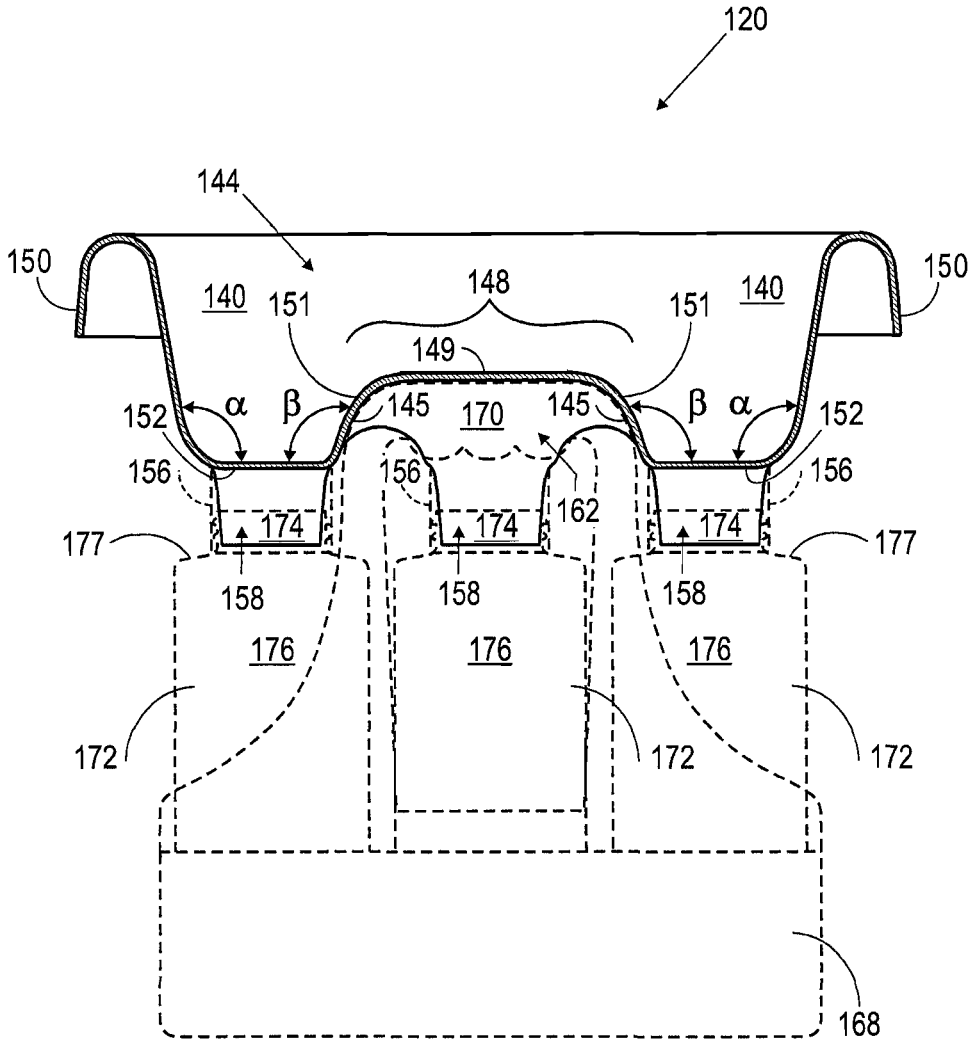
FIG. 11 is a sectional elevation through line 11-11 of FIGS. 9 & 10.

As shown in FIG. 10-11, the tray 120 has a bottom surface 152 opposing the tray surface 122, with the channel openings 146*a*-146*f* extending through and accessible from the bottom surface 152. A plurality of channel walls 154, each having an interior surface 156, extend from the bottom surface 152 to form cylindrical channels 158, with one channel 158 being positioned subjacent to each one of the channel openings 146*a*-146*f*. However, it is anticipated that the shape of the channels 158 could vary depending upon the shape of the receptacles.

According to this alternative embodiment, the length of the tray 120 along the axis of orientation 132 is 14.64 inches. The length of the tray surface 122 is 10.645 inches. The maximum width of the tray 120 11.2 inches. The width of the tray surface 122 is 7.197 inches. Each channel opening 146*a*-146*f* has minimum diameter of 1.4 inches. Angle $\alpha$ is one-hundred ten degrees. Angle $\beta$ is one-hundred degrees. The handle opening 160 is 5.619 inches by 1.161 inches.

Referring to FIG. 11, in the preferred embodiment, the distances from the bottom of the channel wall 154 to the top of the tray volume 144 is 4.75 inches. The height of each channel wall 154 is 1.025 inches. The distances between the topmost point of the handle cover 148 and the bottom surface 152 is 1.282 inches.

Figure 12:
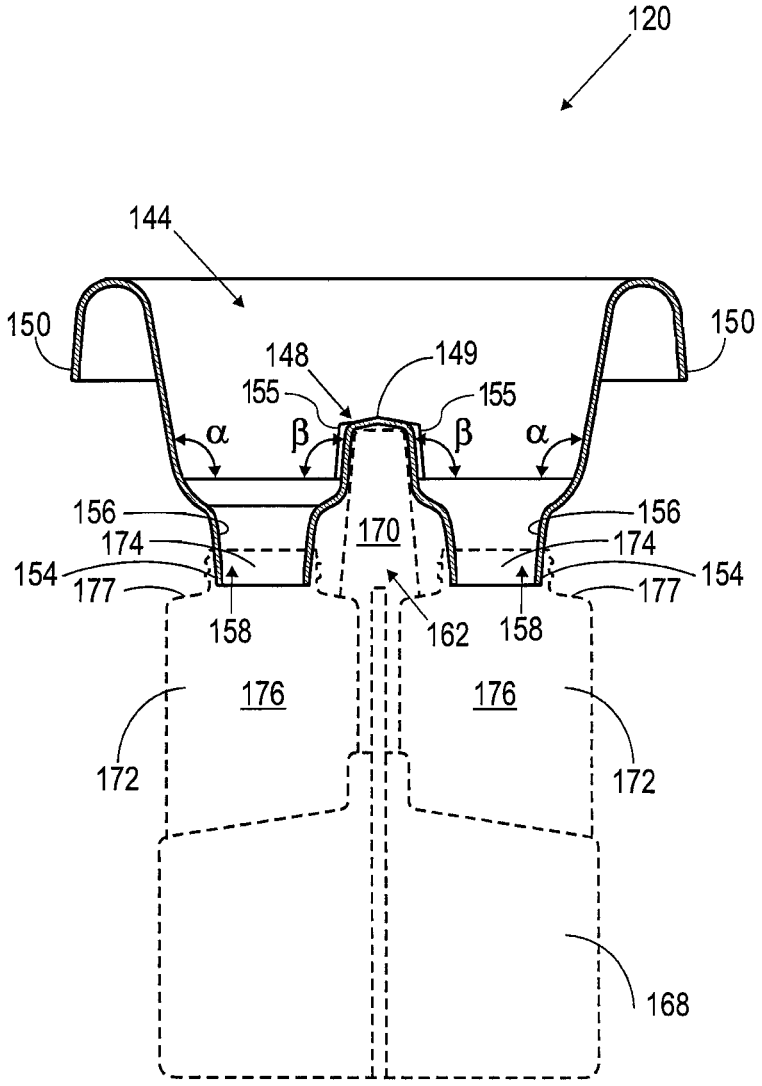
FIG. 12 is a sectional elevation through line 12-12 of FIGS. 9 & 10.

FIGS. 11-12 show how the tray 120 of the preferred embodiment may be used with a multiple receptacle carrier 168 with a carrier handle 170. The carrier 168 holds six identical drink receptacles 172, such as sports beverage containers, in two rows of three receptacles 172 each. Each receptacle 172 has a cylindrical top portion 174 for receiving a lid and a cylindrical body portion 176 subjacent to its top portion 174, with the body portion 176 having an outer diameter greater than the outer diameter of the top portion 174 forming a shoulder 177 therebetween. However, it is anticipated that other embodiments of the tray 120 could be used with various receptacle carriers 168 and shapes of drink receptacles 172.

In this embodiment, the outer diameter of each channel wall 154 is smaller than outer diameter of the top portions 174 of the drink receptacles 172. The handle opening 160 has a width greater than the width of the carrier handle 170, and a length greater than the length of the carrier handle 170. When the tray 120 is properly positioned on the receptacle carrier 168, the tray 120 is supported the bottom end of the channel walls 154 contact the shoulder 177 and the carrier handle 170 inserts through the handle opening 160.

Still referring to FIGS. 4-5, the handle cover 148 is positioned to and covers the carrier handle 170 when the tray 120 is properly positioned on the carrier. Preferably, the elongate portions of the sidewall 151 of the handle cover 148 are flexible so that they may be urged inward against the carrier handle 170 when the handle cover 148 is grabbed. In this manner, the carrier handle 170 may be grasped with the handle cover 148 and lifted along with the tray 120.

Use of the tray 120 is as described with reference to the preferred embodiment and FIGS. 6-7.

The present invention is described above in terms of preferred illustrative embodiments of specifically-described apparatus. Those skilled in the art will recognize that alternative constructions can be used in carrying out the present invention. Other aspects, features, and advantages of the present invention may be obtained from a study of this disclosure and the drawings, along with the appended claims.

I claim:

1. A tray for channeling material, the tray having a primary longitudinal axis of orientation and comprising:

a tray surface;

a bottom surface opposing said tray surface;

a plurality of channel openings;

a handle opening extending to said bottom surface and extending through said tray surface and said bottom surface;

a sidewall extending from said tray surface, said sidewall comprising an interior surface and an exterior surface, wherein said interior surface of said sidewall and said tray surface define a tray volume; and a plurality of channel walls, wherein said plurality of channel walls extend from said bottom surface to define channels positioned below and adjacent to each of said channel openings.

2. The tray of claim 1 wherein said tray surface comprises a plurality of sloped surfaces angled relative to the tray surface and positioned adjacent said channel openings.

3. The tray of claim 1 wherein the angle between said interior surface and said tray surface is between one-hundred five and one-hundred fifteen degrees, inclusive.

4. The tray of claim 1 further comprising a handle cover having a top surface and a surrounding sidewall with an exterior surface, said handle cover extending away from said tray surface and covering said handle opening.

5. The tray of claim 4 wherein said exterior surface of said surrounding sidewall of said handle cover is angled at least ninety degrees relative to the tray surface.

6. The tray of claim 4 wherein said exterior surface of said surrounding sidewall of said handle cover is between ninety and one-hundred ten degrees, inclusive, relative to the tray surface.

7. The tray of claim 4 wherein said handle cover is comprised of a flexible material.

8. The tray of claim 1 wherein each of said channels is cylindrical.

9. The tray of claim 1 wherein said plurality of channel openings are arranged in a rectangular pattern.

10. The tray of claim 1 wherein said plurality of channel openings consists of six circular openings, and wherein said handle opening is rectangular and between at least two of said channel openings.

11. The tray of claim 10 wherein said six channel openings comprises a first group of three openings having centers aligned along a first longitudinal axis that is parallel to said primary axis of orientation and a second group of three openings having centers aligned along a second longitudinal axis that is parallel to said primary axis of orientation, said primary axis of orientation being positioned between said first and second longitudinal axes.

12. The tray of claim 1 further comprising at least one laterally-orientated handle extending from the exterior surface of said sidewall of said tray.

13. The tray of claim 1 further comprising an angle between said interior surface of said sidewall and the tray surface which is at least ninety degrees.

14. A system for channeling material into a plurality of receptacles having a combined volume, the plurality of receptacles being held in a carrier with a handle, each of the receptacles having a receptacle opening, comprising:

a tray surface;

a bottom surface opposing said tray surface;

a plurality of channel openings;

a handle opening extending through said tray surface and said bottom surface;

a sidewall extending from said tray surface, said sidewall comprising an interior surface and an exterior surface, wherein said interior surface of said sidewall and said tray surface define a tray volume;

a plurality of channel walls, wherein said plurality of channel walls extend from said bottom surface to define channels positioned below and adjacent to each of said channel openings; and said handle opening positioned to simultaneously receive the handle of the carrier inserted therethrough and align said channels with said receptacle openings.

15. The system of claim 14 wherein said tray surface comprises a plurality of sloped surfaces angled relative to the tray surface and positioned adjacent said channel openings.

16. The system of claim 14 wherein the tray volume is at least equal to the combined volume of the receptacles.

17. The system of claim 14 wherein said receptacle opening of each receptacle is positioned within one of said channels when said handle is fully inserted through said handle opening.

18. The system of claim 14 wherein each channel is positioned through a receptacle opening when said handle is fully inserted through said handle opening.

19. The system of claim 14 further comprising an angle between said interior surface of said sidewall and the tray surface which is at least ninety degrees.

20. The system of claim 14 comprising a handle cover having a top surface and a surrounding sidewall, the handle cover extending away from said tray surface and covering said handle opening.

* * * * *